US005850172A

United States Patent [19]

Lenz et al.

[11] Patent Number: 5,850,172

[45] Date of Patent: Dec. 15, 1998

[54] EMERGENCY SERVICE RESCUE MARKER

[75] Inventors: Vernon C. Lenz, Yakima; Carey L. Moore, Oceanside, both of Calif.

[73] Assignee: Golden West Communications, Inc., Yakima, Wash.

[21] Appl. No.: 979,822

[22] Filed: Nov. 23, 1992

Related U.S. Application Data

[63] Continuation of Ser. No. 492,736, Mar. 13, 1990, Pat. No. 5,216,418.

[51] Int. Cl.[6] ..... G08B 3/00

[52] U.S. Cl. ..... 340/384.1; 340/546

[58] Field of Search ..... 340/815.21, 546, 340/332, 384.1

[56] References Cited

U.S. PATENT DOCUMENTS

| | | | |
|---|---|---|---|
| 2,216,876 | 10/1940 | Crum | 248/231.8 |
| 3,969,720 | 7/1976 | Nishino | 340/815.21 |
| 4,284,981 | 8/1981 | Black | 340/546 |
| 4,438,428 | 3/1984 | Ober et al. | 340/546 |
| 5,216,418 | 6/1993 | Lenz et al. | 340/815.21 |

*Primary Examiner*—Matthew Luu

*Attorney, Agent, or Firm*—Art Freilich; Robert Hornbaker; Leon Rosen

[57] ABSTRACT

A marker is provided for use by emergency service personnel entering a room of a building, to keep the door from latching closed while he/she searches the room, and later help him find the door to exit the room, and to indicate to other rescuers that a search is in progress or has been completed. The marker includes a housing (12, FIG. 1) and a door clamp (14) mounted on the housing and constructed to fit on a door to prevent complete closing of the door. The housing holds an audible alarm generator (20) which generates sound beeps to help a searcher find the door in an environment of thick smoke. With the door clamp holding the door ajar, the sound beeps can be heard from outside the room, so another searcher can determine that a search is in progress. The alarm is settable to generate a different pattern of sound beeps, to indicate that a search is in progress, or has been completed. It also generates light flashes. The door clamp can include a length of wire that extends around the outer edge of a door. The wire door clamp can be pivoted on the housing between a stowed configuration wherein it lies adjacent to the housing before mounting compactly on a searcher's belt, and in a deployed configuration wherein it projects from the housing and can clamp to a door.

5 Claims, 2 Drawing Sheets

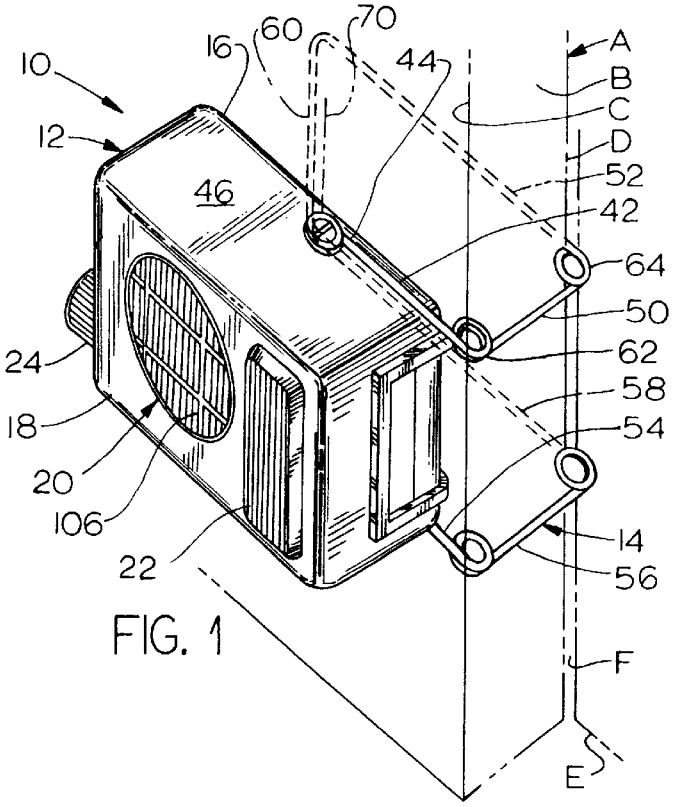
FIG. 1
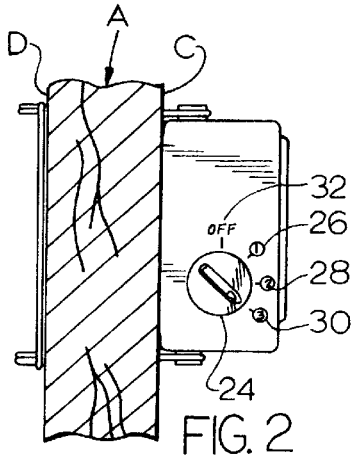
FIG. 2
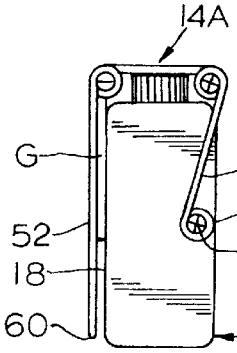
FIG. 4
FIG. 3
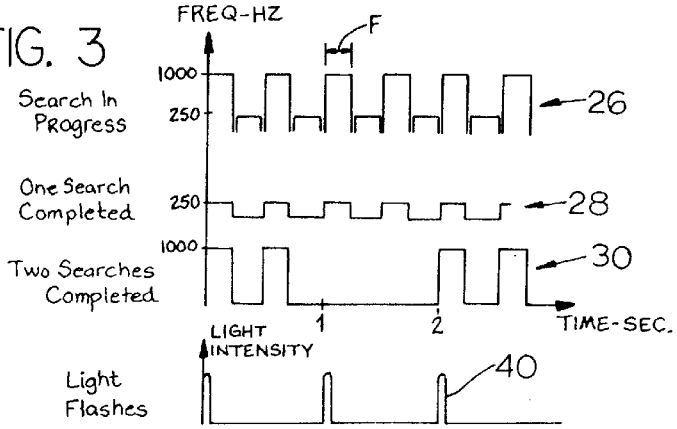
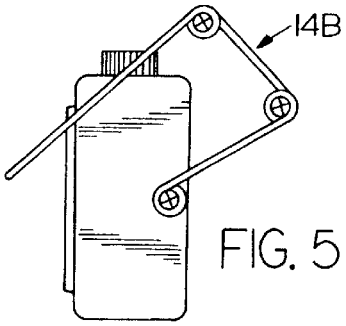
FIG. 5
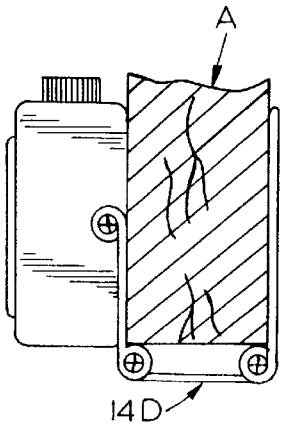
FIG. 7
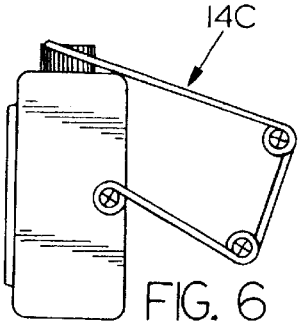
FIG. 6

EMERGENCY SERVICE RESCUE MARKER

This is a CONTINUATION of application Ser. No. 07/492,736 filed on May 13, 1990, which is now U.S. Pat. No. 5,216,418.

A marker is provided for use by emergency service personnel entering a room of a building, to keep the door from latching closed while he/she searches the room, and later help him find the door to exit the room, and to indicate to other rescuers that a search is in progress or has been completed. The marker includes a housing (12, FIG. 1) and a door clamp (14) mounted on the housing and constructed to fit on a door to prevent complete closing of the door. The housing holds an audible alarm generator (20) which generates sound beeps to help a searcher find the door in an environment of thick smoke. With the door clamp holding the door ajar, the sound beeps can be heard from outside the room, so another searcher can determine that a search is in progress. The alarm is settable to generate a different pattern of sound beeps, to indicate that a search is in progress, or has been completed. It also generates light flashes. The door clamp can include a length of wire that extends around the outer edge of a door. The wire door clamp can be pivoted on the housing between a stowed configuration wherein it lies adjacent to the housing before mounting compactly on a searcher's belt, and in a deployed configuration wherein it projects from the housing and can clamp to a door.

BACKGROUND OF THE INVENTION

When the firefighters arrive at a burning structure such as an office or apartment building, they must first conduct a "search and rescue" operation wherein they search each room of the building to make sure no one is left behind. An important consideration in searching a room, is to make sure that the door does not close completely, lock, and prevent exit of the firefighter. It is also desirable to provide help to the firefighter in finding the door through which he entered the room, if the room is dark and filled with smoke, if the firefighter becomes disoriented, or if self contained breathing apparatus is exhausted. It is also desirable to allow other firefighters to keep track of those who are searching a room, to enable rapid rescue of a firefighter overcome by smoke. A relatively low cost, compact device allowing a firefighter to keep a door from completely closing after entering a smoke filled room, and that could maintain location orientation while notifying other personnel of the firefighter's location, would be on considerable value.

SUMMARY OF THE INVENTION

In accordance with one embodiment of the present invention, a rescue marker is provide to aid firefighters and others in the search of rooms of a building. The marker includes a housing and a door clamp mounted on the housing and constructed to fit on a door to prevent complete closing of it. The housing holds an audible alarm generator that is constructed to generate time-spaced sound beeps. Although the sound generator lies on one side of the door such as the inside while the firefighter searches a room, the fact that the door is open allows the sound to be heard form the other side of the room so other firefighters passing the door know that a search of the room is in progress. The alarm is manually settable in a first mode wherein it emits beeps of different pitches, and in a second mode wherein it emits beeps of a single pitch, to indicate whether a search is in progress or a search has been completed.

The door clamp includes a length of wire having a first leg mounted on the housing to extend along a first side of the door, a second leg extending largely perpendicular to the first to extend along the outer edge of the door, and a third leg extending largely parallel to the first to extend along a second side of the door. The first leg can be pivotally mounted on the housing to enable the door clamp to be pivoted between a stowed configuration wherein it does not project much from the housing, and a deployed configuration wherein it projects from the housing to clamp to the door. The wire can be formed with at least one coil spring-like turn at the intersection of the first and second legs, and at the intersection of the second and third legs, to provide strong clamping action.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of a rescue marker constructed in accordance with the present invention, shown mounted on a door.

FIG. 2 is a rear elevation view of the rescue marker and a portion of the door of FIG. 1.

FIG. 3 is a graph showing the variation in sound output with time for three modes of operation of the apparatus of FIG. 1, and also showing the variation in light intensity with time for each of those modes.

FIG. 4 is a plan view of the rescue marker of FIG. 1, with the door clamp in the stowed configuration and mounted on a firefighter's belt.

FIG. 5 is a plan view of the rescue marker of FIG. 4, with the door clamp partially pivoted towards a deployed configuration.

FIG. 6 is a view similar to that of FIG. 5, with the door clamp pivoted further towards the deployed configuration.

FIG. 7 is a plan view of the rescue marker of FIG. 6, but in the fully deployed configuration, and shown mounted on a door.

DESCRIPTION OF THE PREFERRED EMBODIMENTS

Figure 8:
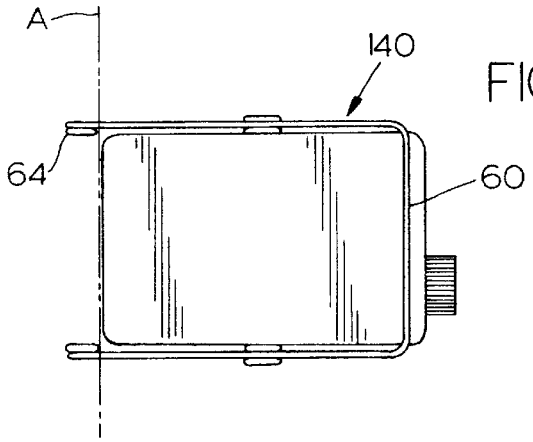
FIG. 8 is a rear view of the rescue marker of FIG. 7, but with the door shown in phantom lines.

FIG. 1 illustrates a rescue marker 10 of the present invention which can be mounted on a door A having an outer edge B and first and second opposite sides C, D. The rescue marker includes a housing 12 shown lying against the second or inner side of the door and a door clamp 14 which surrounds the outer portion of the door. The door clamp projects outwardly far enough to abut the door jamb E to prevent closing of the door and to leave at least a small gap F between the door and door jamb. The housing has a first side 16 which lies against the door, and an opposite second side 18 facing away from the door. The housing has an audible or sound generator 20 which generates "beeps", and has a flashing light generator 22 that generates flashes of light. A manually controlled mode selector 24 allows the audible generator to be set in different modes.

FIG. 2 shows that the mode selector 24 can be set in three different operating modes indicated at 26, 28, and 30, as well as an off position 32. Each of these modes controls the sound generator to generate a different sequence of sounds. As shown in FIG. 3, in a first mode 26 the pound generator generates sound beeps that each have a duration F of ¼ second, and that each have a pitch or lowest frequency that is either 1000 Hz (Hertz) or 250 Hertz. The sound beeps of ¼ second each, repeatedly alternate between the 1000 Hz and 250 Hz frequencies. This first mode indicates that a search is in progress, which means that a fireman or searcher is in the room searching for persons to be brought to safety.

In the second mode 28, sound beeps of a frequency of 250 Hz, each of a duration of ¼ second, are sounded at ½ second intervals. The second mode indicates that a searcher is not searching the room, and that a single search has been conducted in the room. A third mode indicated at 30 results in the generation of beeps of 1000 Hz, each of ¼ second duration, in a pattern that includes two beeps spaced ½ second apart followed by silence, and with the pattern repeating every 2 seconds. The third mode indicates that there is not a searcher in the room, and that two searches of the room have been completed. In all modes of operation, light flashes indicated at 40 are generated by the flashing light generator at one second intervals, to help a searcher find the marker.

When a searcher enters a room to search it, he/she first installs the rescue marker on the door as shown in FIG. 1, with the housing 12 on the inner side of the door which faces the inside of the room. As discussed above, the door clamp 14 prevents complete closing of the door, and assures that the door does not latch closed. If there are no lights on in the room and there is thick smoke so the searcher's flashlight is not very effective, the sound beeps nevertheless help guide the searcher to the door. As the searcher approaches the door, the light flashes further to help him locate the door. The fact that the door clamp prevents closing the door assures that, even if the door is of a type that requires a key to open from the inside, the door will not completely close or latch and therefore the searcher is assured of being able to exit.

When the searcher exits the room, he removes the rescue marker form the door, and sets it in the second mode at 28 (assuming it is the first search of the room). The searcher then clamps the rescue marker to the door so that the housing 12 lies at the second or outer side D of the door. The beeps then indicate to any passing emergency service personnel that a search has already been made of the room, and that there is no searcher in the room who is conducting a search. If the searcher has just completed searching a room following an initial search from a previous rescuer, the mode control can be set to the third mode 30 to indicate that two searches of the room have occurred. In many jurisdictions it is common to require that whenever searches can be safely conducted, that each room be searched twice before emergency service personnel leave the building. Setting the marker in the second mode clearly indicates that two searches have been conducted.

When a search is in progress, the rescue marker not only serves to help the searchers find their way back to the door and assure that the door can still be opened, but also indicates to other personnel passing the room that a search is in progress. The fact that the door clamp keeps the door slightly ajar, results in a considerable amount of the sound from the marker passing through the open gap to be heard by other personnel passing through the hallway outside the door. Some doors, especially those in more expensive office buildings, are purposely constructed to block sound. By having the door open slightly so passing personnel can readily hear the sound beeps, other passing personnel who notice that he marker has remained in the search mode more than usual, such as more than about 30 seconds may realize that they should check to see that the searcher is all right.

The door clamp 14 is formed by a long length of wire. The wire includes a first leg 42 with an inner end 44 mounted on the top 46 of the housing (which is uppermost in the first mode of operation but bottommost in the second and third modes). The wire also includes a second leg 50 that extends largely perpendicular to the first leg and along the outer edge B of the door. The wire also includes a third leg 52 that extends largely perpendicular to the second legend along the second side D of the door. The wire is springy and the first and third legs 42, 52 tend to press towards one another to clamp to the door. The wire has an opposite lower portion with first second and third legs 54, 56, and 58, with the upper and lower wire portions joined by a vertical wire portion 60. The springiness of the wire holds it tightly against the door to hold the housing in place. Such springiness is enhanced by providing at least about one turn 62, 64 in the wire at opposite ends of the second leg 50, 56 to form springs thereat. The length of each second leg 50, 56 of the door clamp is about 2½ inches, to readily clamp to most doors which are of a thickness of about 1¾ inches.

The rescue marker is designed to be carried in a stowed configuration, shown in FIG. 4, wherein it occupies little room and can be easily carried, and to be easily converted to a deployed configuration shown in FIGS. 1 and 7. As shown in FIG. 4, the inner end 44 of each first leg 42, 54 of the door clamp is pivotally mounted about an axis 70 on the housing 12. In the stowed configuration, the third legs such as 52 extend over the second side 18 of the housing, with the width of the housing taking up most of the width of the door clamp. The third legs such as 50 and the connecting part 60 can easily fit over the belt G of the wearer, to facilitate carrying of the markers. When the searcher wishes to use the marker, he pulls it up off his belt, and turns the clamp from the stowed position 14A to the configuration shown at 14B in FIG. 5, wherein the clamp has been turned partially towards it deployed position. Further turning of the clamp moves it to the position 14C of FIG. 6, and finally to the deployed configuration 14D shown in FIG. 7. Thus, while the door clamp must project a considerable distance such as 2 to 3 inches from the housing in the deployed configuration, it projects by a very small amount from the housing in the stowed configuration, and then also forms a belt clip to facilitate hanging on the searcher's belt.

Figure 9:
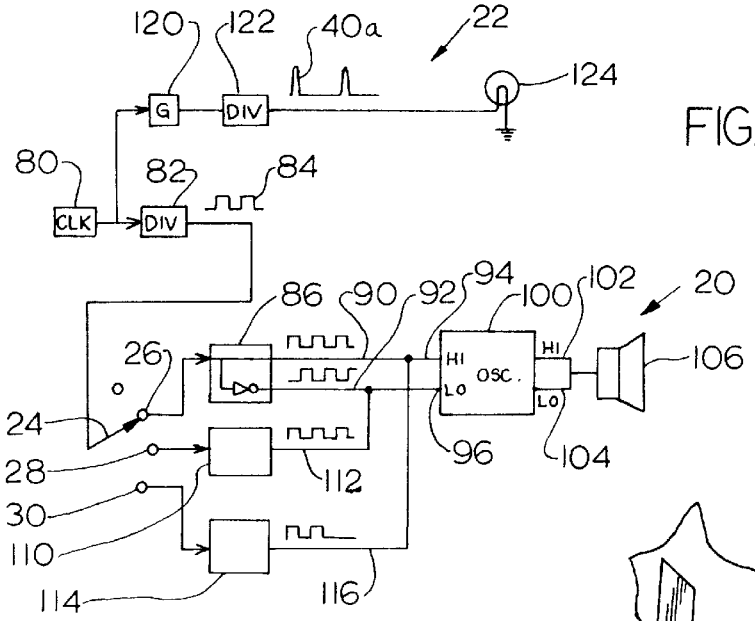
FIG. 9 is a simplified circuit diagram of the circuitry of the rescue marker of FIG. 1.

FIG. 9 is a simplified circuit diagram of the circuitry of the audible generator 20 and flashing light generator 22 in the housing of the rescue marker. The circuit includes a clock 80 that delivers its output to a divider 82 whose output indicated at 84 is a binary signal of a frequency of 2 Hz. In a first mode 26 of the mode selector 24, the output from the divider is delivered to a logic circuit 86 whose outputs 90 and 92 equal the input and the inverse of the input, respectively. The outputs 90, 92 are delivered to the high and low inputs 94, 96 of an oscillator 100. The oscillator delivers outputs 102, 104 of frequencies of 1000 Hz and 250 Hz, respectively. These outputs are delivered to a loudspeaker 106. When the switch 24 is switched to the second mode 28 the output of the divider 82 is delivered to another logic circuit 110 whose output 112 is the same as its input, and whose output is connected to the low input 96 of the oscillator. When the mode control is in the third mode 30 the output of the divider is delivered to another logic circuit 114 which delivers ½ second segments of its input at two second intervals, with the output 116 delivered to the high input 94 of the oscillator.

The output of the clock 80 is also delivered through a gate 120 to a divider 122 which delivers pulses indicated at 40a to a lamp 124. If the gate 120 is left closed each time the clock 80 is started (when the unit is turned from "off" to any mode) then the output of the lamp 124 will be synchronized with the output of the loudspeaker 106, as indicated in FIG. 3. Such synchronization is useful to enable emergency service personnel walking down a hallway, wherein there are several markers operating, to determine which marker light belongs with which marker sound output. The gate 120 can be opened for a short period of time to shift the exact times when the flashes of light are generated, as will be described below.

Figure 10:
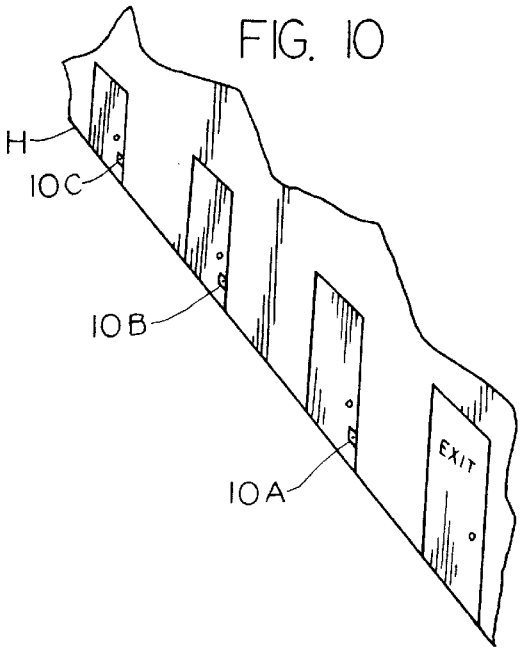
FIG. 10 is a perspective view of doors in a building, showing how a group of recuse markers of the type shown in FIG. 1 can be mounted thereon.
Figure 11:
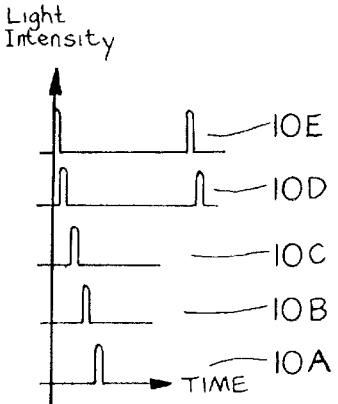
FIG. 11 is a graph showing variation in light intensity with time for the different rescue markers of FIG. 10.

FIG. 10 illustrates a building hallway H and several markers 10A, 10B, and 10C on different doors of the hallway. Applicant can time the flashes of the markers so that the flashes operate in a predetermined sequence indicating the direction to the exit of a building. That is, the flashes operate in a sequence similar to that of the lights along an airplane runway. FIG. 11 illustrates the sequence of flashes produced by several markers 10A–10E. The marker 10E furthest from the hallway produces a flash first. A short period of time such as 100 milliseconds later, the next flasher 10D produces a flash. This continues until the marker 10A closest to the exit produces a flash. The sequence repeats. A firefighter in the hallway who is seeking an exit, sees the sequence of flashes which lead him to the exit.

Before emergency service personnel enter a building and begins searching the rooms on a floor, they carry several rescue markers with them. The sequence of flashes of the markers can be set by operating the gate 120 (FIG. 9) to delay the onset of the flash of each of the markers until the flashes occur in the desired sequence. The marker with the last-to-occur flashes is designated to be the first flasher to be installed, on the door nearest an exit, with markers whose flashes occur progressively sooner positioned on doors progressively further from the exit.

Thus, the invention provides a rescue marker that can be carried by a rescuer and used to aid in rescue operations. The marker includes a housing with at least a sound generator that generates sound beeps and a door clamp which clamps the housing to a door and which prevents closing of a door. The sound generator preferably can be set in a plurality of different modes, including a first mode that indicates that a search is in progress, and one or more additional modes that indicate that a search has been completed. The door clamp can include a wire bent to clamp around the outer edge of a door, and which is pivotally mounted on the housing so it can be pivoted to a stowed position wherein the door clamp does not project more than a small amount from the housing. The marker preferably also produces light flashes, and the sequence of flashes of a group of markers can be controlled to produce a sequence of flashes simulating that of airplane runway lights, to indicate the exit from a hallway.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. An emergency service rescue marker for use by firefighters or similar rescue personnel to indicate the direction to a door that closes a room, to both a first rescuer who enters the room and a fellow rescuer who is located outside the room and must know if there is a rescuer in the room, comprising:

a housing;

a door clamp mounted on said housing and constructed to prevent complete closing of the door so the door can be readily opened;

an audible signal generator mounted on said housing and constructed to generate sound, whereby to allow sounds from the alarm to easily fill rooms on both sides of a door held by the door clamp;

a manually operable switch mounted on said housing and connected to said audible generator to turn it on and off, said generator commencing to generate said beeps when said switch is turned on and ceasing to generate said beeps when said switch is turned off.

2. An emergency service rescue marker for mounting on a door having first and second opposite sides and a vertical outer edge, comprising:

a housing;

an audible signal generator mounted on said housing;

a door clamp mounted on said housing for clamping it to said vertical edge of said door;

said door clamp including a length of wire having a first leg mounted on said housing to extend beside the first side of the door, a second leg which extends from said first leg and largely perpendicular to said first leg and along a distance of about two inches to extend along the outer edge of the door, and a third leg which extends from said second leg and largely perpendicular to said second leg to extend along the second side of the door, said wire having at least one turn of a coil spring at each end of said second leg for urging locations along said first and third legs toward each other to tightly clamp to the vertical edge of the door.

3. The marker described in claim 2 wherein:

said housing has a top and a bottom, and said first leg of said door clamp lies at said top of said housing;

said length of wire includes a fourth leg mounted on said bottom of said housing and extending parallel to said first leg, a fifth leg which extends from said fourth leg and parallel to said second leg, a sixth leg which extends from said fifth leg and parallel to said third leg, and a seventh leg which joins said third and sixth legs.

4. A method for use by a firefighter to mark the location of a door to a room in a burning building, comprising:

establishing an audible alarm on a doorstop;

mounting said doorstop on a door that is open to a room in a burning building to keep said door open so it can be readily pushed open, and manually turning on said alarm, whereby to enable sounds from said alarm to be heard on both sides of said room.

5. An emergency marker installation which includes an emergency service rescue marker used in conjunction with a door to a room being searched, to indicate the location of the door, characterized by:

said door is ajar so its outer edge is away from the door jamb, said rescue marker has an audible alarm, and said rescue marker is clamped to said door outer edge with a portion of said rescue marker projecting beyond said door outer edge to interfere with said door jamb to keep the door ajar.

* * * * *